US011167881B2

(12) United States Patent
Jiang et al.

(10) Patent No.: US 11,167,881 B2
(45) **Date of Patent: *Nov. 9, 2021**

(54) DECK STORAGE BOX

(71) Applicant: PLASTIC DEVELOPMENT GROUP, Southfield, MI (US)

(72) Inventors: Yixiang Jiang, Yuyao (CN); Richard Gilbert, Castle Rock, CO (US); Ed Wu, Naperville, IL (US)

(73) Assignee: PLASTIC DEVELOPMENT GROUP, Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,826

(22) Filed: Sep. 20, 2019

(65) Prior Publication Data

US 2020/0010237 A1 Jan. 9, 2020

Related U.S. Application Data

(63) Continuation of application No. 15/431,060, filed on Feb. 13, 2017, now Pat. No. 10,427,831.

(51) Int. Cl.
*B65D 6/24* (2006.01)
*B65D 25/28* (2006.01)

(52) U.S. Cl.
CPC ..... *B65D 11/1873* (2013.01); *B65D 25/2897* (2013.01)

(58) Field of Classification Search
CPC ..... B65D 25/2897; B65D 11/1873; B65D 2519/00034; B65D 11/20; A47B 47/042
See application file for complete search history.

(56) References Cited

U.S. PATENT DOCUMENTS 4,466,541 A 8/1984 Tabler et al.
5,012,943 A * 5/1991 King ..... B65D 11/1873 220/4.32
6,497,018 B1 12/2002 Chiu et al.
6,701,573 B1 * 3/2004 Ciavarella ..... E05D 7/1055 16/257
7,028,859 B2 * 4/2006 Moon ..... B65D 11/1873 220/4.28
8,689,992 B2 4/2014 Anderson et al.
8,875,939 B2 11/2014 Phillips et al.
(Continued)

FOREIGN PATENT DOCUMENTS

CN 201610378441 * 5/2016

*Primary Examiner* — Shawn M Braden
(74) *Attorney, Agent, or Firm* — Dickinson Wright PLLC

(57) ABSTRACT

A deck box includes individual panels and a lid that are able to be assembled to one another without the need for external hardware. A bottom panel has guides or rails extending along the length of the bottom panel at opposing edge regions thereof. A pair of side panels are provided with guides or rails to enable sliding engagement and assembly of the side panels with the bottom panel. The side panels are also provided with guides or rails that extend toward the bottom panel when the side panels are assembled to the bottom panel. Front and rear panels are provided with guides or rails so that each of the front and rear panel can assemble between the assembled side panels, sliding into engagement in a direction toward the bottom panel. A lid has an integrally-molded hinge member that engages with an integrally-molded hinge member of the rear panel.

11 Claims, 5 Drawing Sheets

(56) References Cited

U.S. PATENT DOCUMENTS

| | | | |
|---|---|---|---|
| D723,803 | S | 3/2015 | Thuma et al. |
| 9,398,806 | B2 | 7/2016 | Mitchell |
| 2017/0342753 | A1 | 11/2017 | Jiang |
| 2017/0343022 | A1 | 11/2017 | Jiang |

* cited by examiner

DECK STORAGE BOX

CROSS-REFERENCE TO RELATED APPLICATIONS

This application is a continuation of U.S. application Ser. No. 15/431,060 filed Feb. 13, 2017, the disclosure of which is hereby incorporated in its entirety by reference herein.

TECHNICAL FIELD

The present disclosure relates to a storage container for use on a deck or patio. More specifically, this disclosure relates to a storage container with a bottom panel and four side panels that slide into engagement with one another, and a lid that snaps into engagement with one of the panel for ease of assembly without the need for external hardware during assembly.

BACKGROUND

Outdoor storage containers for storing household items such as water toys, seat cushions, children toys and the like are known in the art. A common type of such a container is known as a deck box. Deck boxes are utilized for storing such devices on an outdoor deck or patio of a house. To account for the elements and perhaps water from a nearby pool, deck boxes tend to be made of plastic. Assembly of these units can be troublesome due to the amount of external hardware required, such as screws, nuts, bolts, etc. These hardware pieces can be lost during assembly or can become dislodged from the assembled deck box over time, which can be dangerous for young children who access the deck box.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The use of directional terms herein are meant to be relative to the orientation shown in the Figures to give context to the interplay and relative location of various regions or parts of the deck box. Such terms include "side," "top," "bottom," "front," "back," etc. These terms are mean to give context to the relative location of indicated parts of the deck box relative to other parts of the deck box as shown in the orientation depicted in the Figures, and are not meant to be limiting on the scope of the deck box in any other fashion unless specifically indicated.

Figure 1:
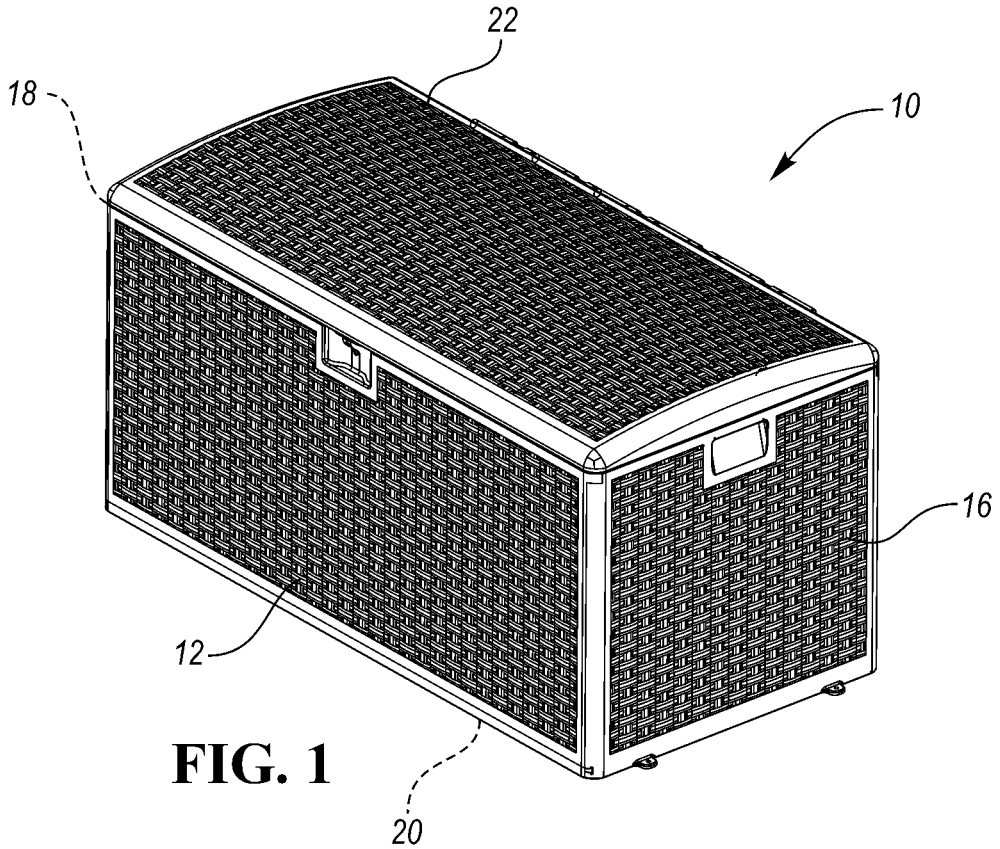
FIG. 1 is a front perspective view of an assembled deck box according to one embodiment.
Figure 2:
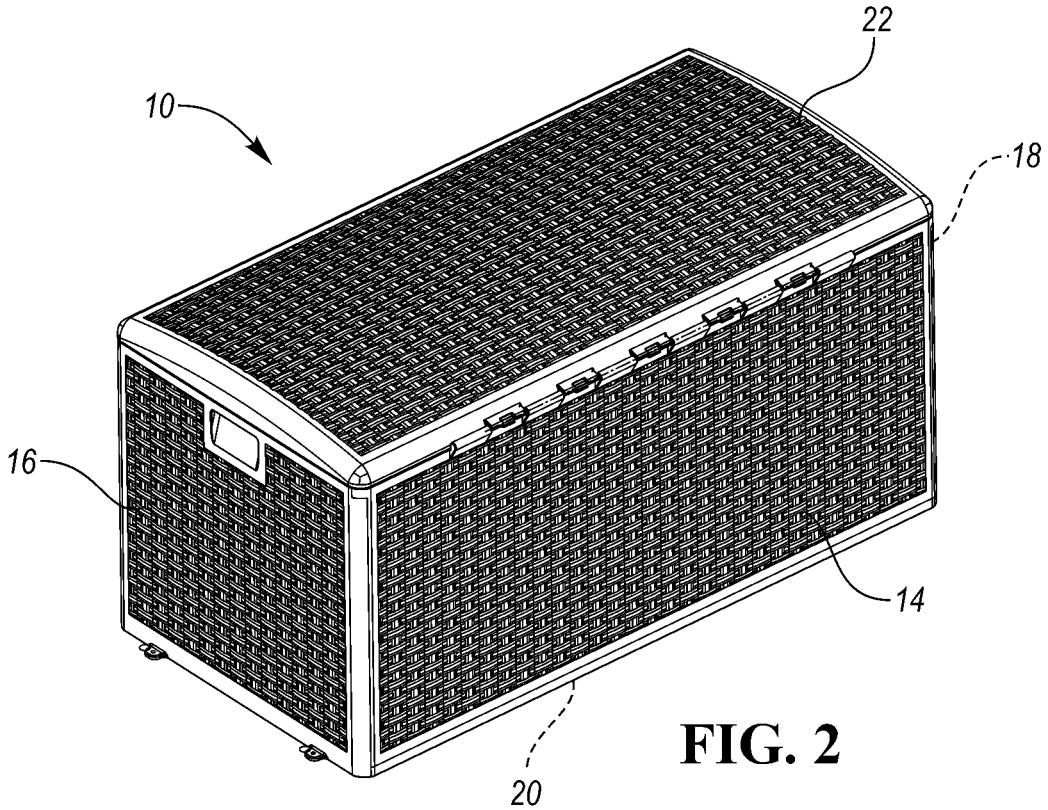
FIG. 2 is a rear perspective view of the deck box of FIG. 1.

Referring to FIGS. 1 and 2, a deck box 10 is illustrated. The deck box includes a front panel 12, a rear or back panel 14, a first side panel 16, a second side panel 18, a bottom panel 20, and a lid 22. As is described in more detail herein, the panels 12-20 are slideably connectable with one another, allowing a user to assemble the deck box by sliding the panels into engagement with one another. The lid 22 is then snap-fit connected to the back panel 14 to form an assembled deck box 10.

The assembled deck box 10 provides a storage device for being placed on an outdoor deck or patio. The engagement of the panels and the lid, given the teachings herein, provides the deck box 10 with the ability to be resistant to the elements (rain, snow, wind, etc.) while safely storing outdoor equipment such as furniture, toys, etc. in a rigid, easy-to-assemble container. Handles may be provided as integrally-molded features on the side panels 16, 18 to allow for transport by the user of the assembled deck box. A locking feature may also be integrally molded therewith, such as a hook extending from the lid 22 that extends through an opening in the front panel 12, as shown in FIG. 1.

In one embodiment, each panel 12-20 and the lid 22 is made of a polymeric material such as plastic (e.g., polyethylene) that is blow-molded to shape. Blow molding of each panel 12-20 and the lid 22 enables the panels 12-20 and lid 22 to be hollow, light weight, and with increased buoyancy as opposed to injection molding. In another embodiment, panels and lid of the deck box are formed by injection molding.

One embodiment of an assembly of the deck box 10 will now be described with reference to the remaining figures.

FIGS. 3-5 show assembly of the product sequentially, according to one embodiment of assembly. Although, it should be understood that other sequences of assembly are contemplated.

Figure 3A:
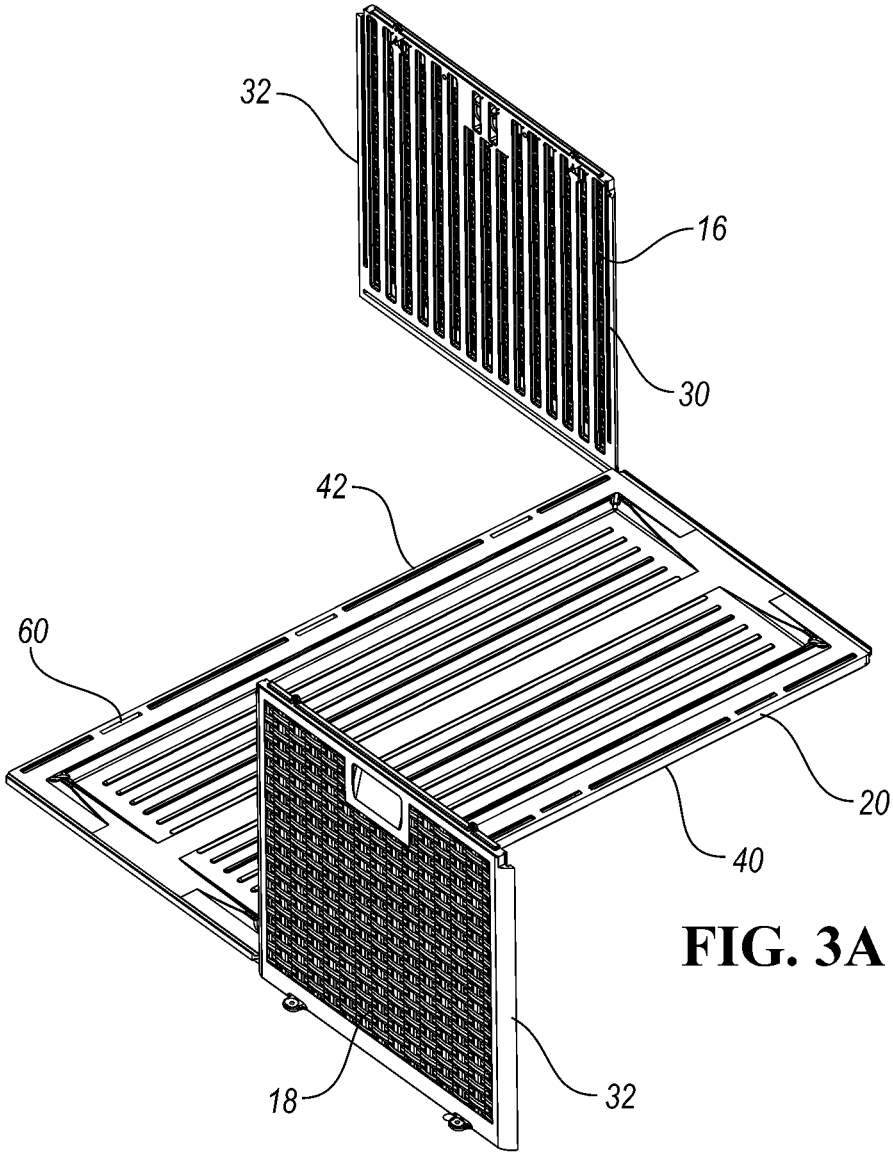
FIG. 3A is a perspective view of a pair of side panels that each have a guide at a bottom edge region for allowing sliding engagement and assembly with a bottom panel that has corresponding guides at its side edge regions, according to one embodiment.
Figure 3B:
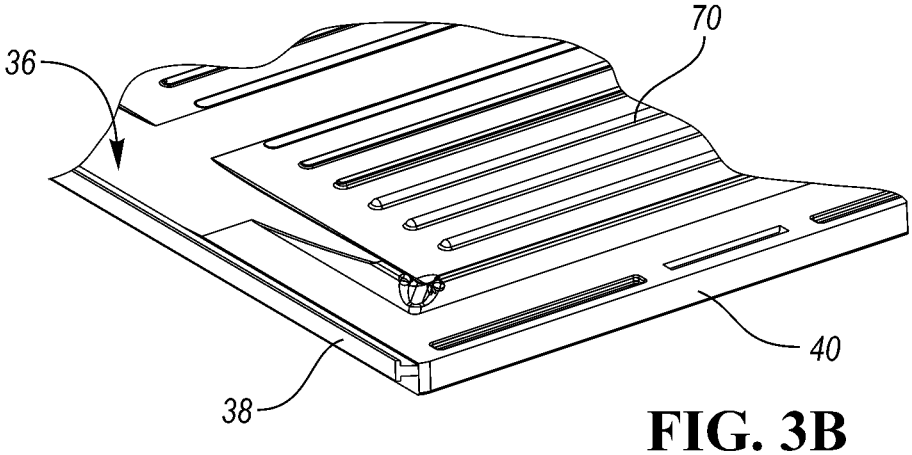
FIG. 3B is an enlarged view of a corner of the bottom panel of FIG. 3A, illustrating one of its rails at a side edge region for engaging with one of the side panels.
Figure 3C:
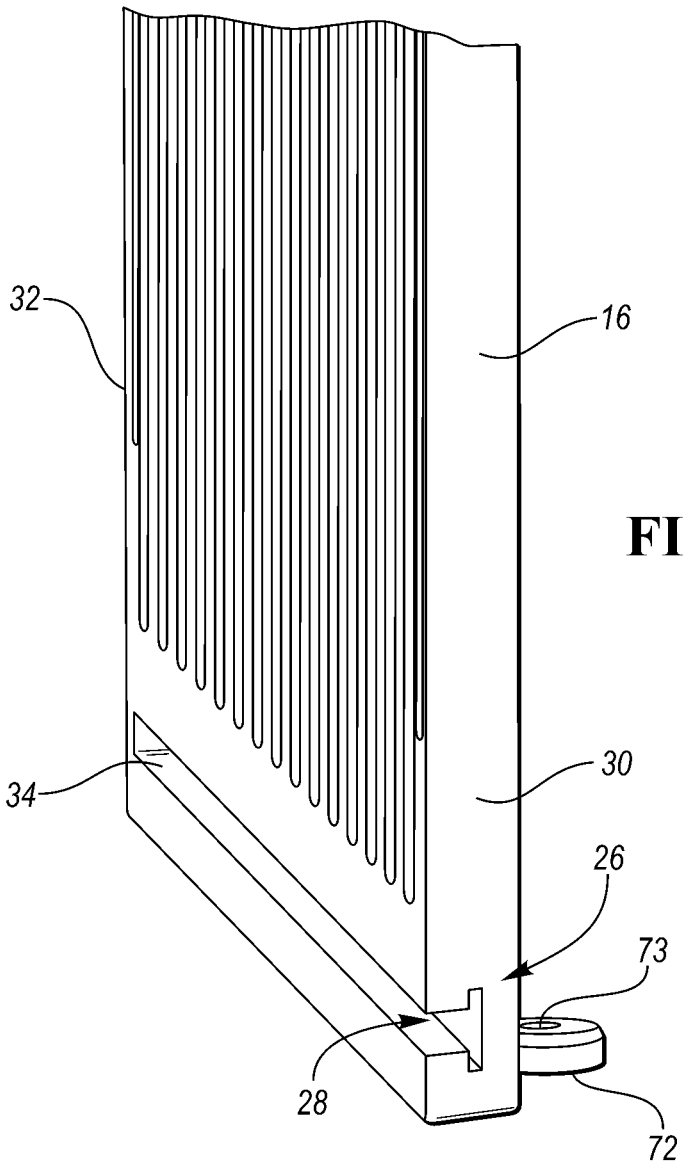
FIG. 3C is an enlarged perspective view of one of the side panels of FIG. 3A, according to one embodiment.

Referring to FIGS. 3A, 3B, and 3C, the side panels 16, 18 are shown ready for assembly with the bottom panel 20. In one embodiment, a bottom edge region 26 of each side panel 16, 18 is each provided with a longitudinal opening such as a track, groove, or pocket, generally referred to as a "guide" 28. The guide 28 may be a T-shaped, as shown in FIG. 3C; however, other shapes are contemplated such as C-shaped, I-shaped, etc. The guide 28 is open on one side surface 30 of each side panel 16, 18, and extends along the width of the panel 16, 18, toward an opposing side surface 32 of the panel 16, 18. In other words, the guide 28 may extend from one side surface 30 and only partially toward the other side surface 32 of the respective side panel 16, 18. The guide 28 ends at end 34 so that the side surface 32 of the side panels 16, 18 is not provided with an opening or access to the guide 28.

A side edge region 36 of the bottom panel 20 has a longitudinal protrusion or the like, generally referred to as a "rail" 38. The bottom panel 20 is provided with two of such rails 38 at opposing side edge regions 36. Each rail 38 is sized to be slideably received within a guide 28 of a corresponding one of the side panels 16, 18. The rail 38 may be T-shaped, as shown in FIG. 3B such that it is configured to slide into engagement with the T-shaped guide 28 from the side. Other shapes are contemplated to match the selected shape of the guide 28. The rail 38 extends completely or partially from a front side surface 40 toward a back side surface 42 of the bottom panel 20.

FIG. 3A shows the beginning of assembly of the side panels 16, 18 with the bottom panel 20. During assembly, each side panel 16, 18 is slid into alignment and engagement with the bottom panel 20 without the need for any external hardware. The open end of the guide 28 at the side surface 30 of each side panel 16, 18 is slid over and across a respective rail 38 of the bottom panel 20. The side panels 16, 18 are slid across the width of the bottom panel 20 until the rail 38 of the bottom panel 20 reaches the end 34 of the guide 28. The relative location of the end 34 of the guide 28 and the rail 38 are such that when the rail 38 reaches the end 34 of the guide 28 the side surfaces 30, 32 of the side panels 16, 18 align with the front and back side surfaces 40, 42 of the bottom panel.

Each side panel 16, 18 can be identical so that when assembled to the bottom panel, each side panel 16, 18 is assembled from opposing directions, as shown in FIG. 3A. In other words, the opening of the guide 28 on the side surface 30 of one side panel 16 faces the front of the deck box 10, and the opening of the guide 28 on the side surface 30 of the other side panel 18 faces the back of the deck box 10.

Figure 4A:
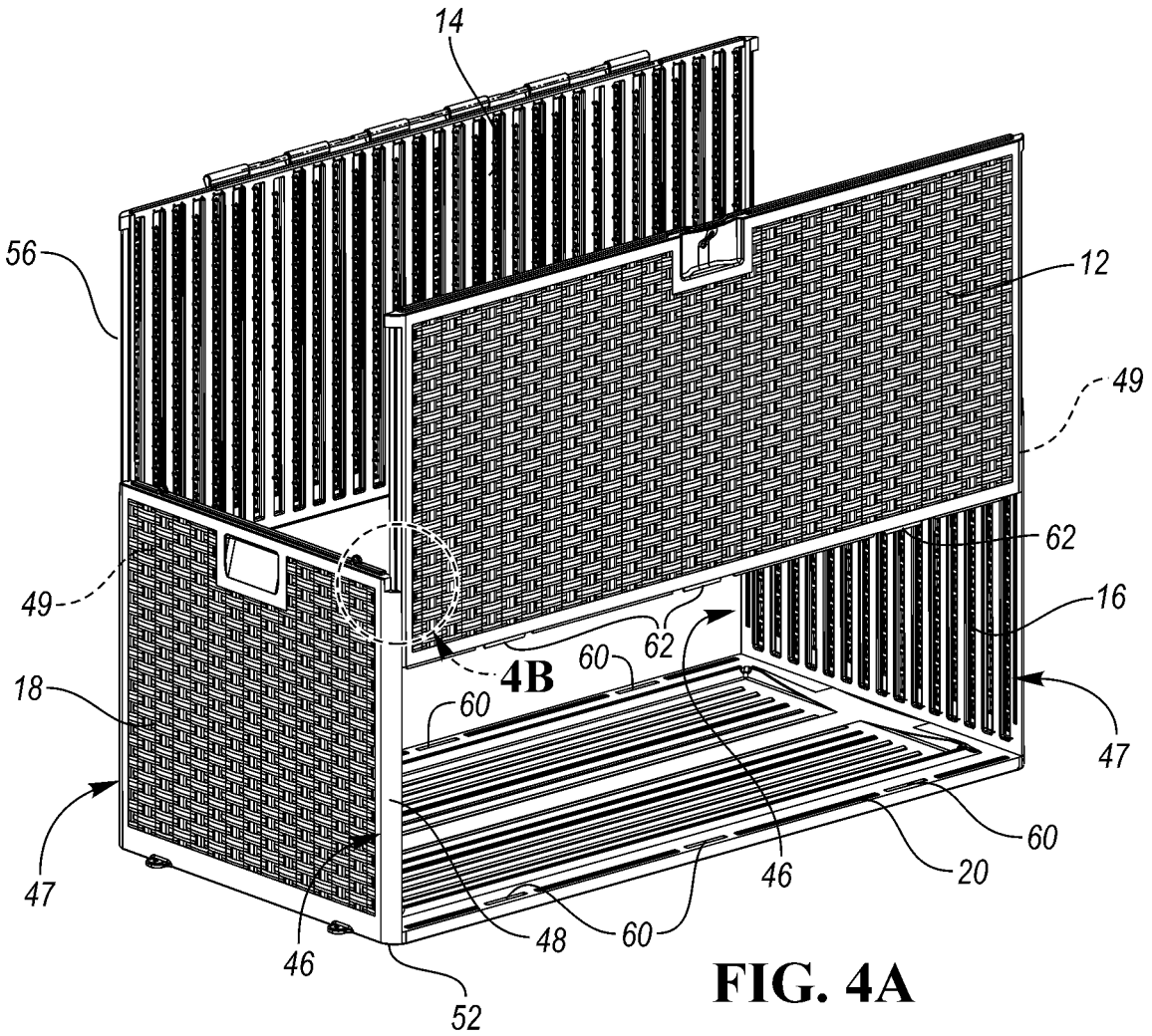
FIG. 4A is a perspective view of a front panel and a rear panel being assembled between the assembled side panels. The side panels have guides at each side edge region thereof for enabling sliding engagement with rails of the front and rear panels, according to one embodiment.
Figure 4B:
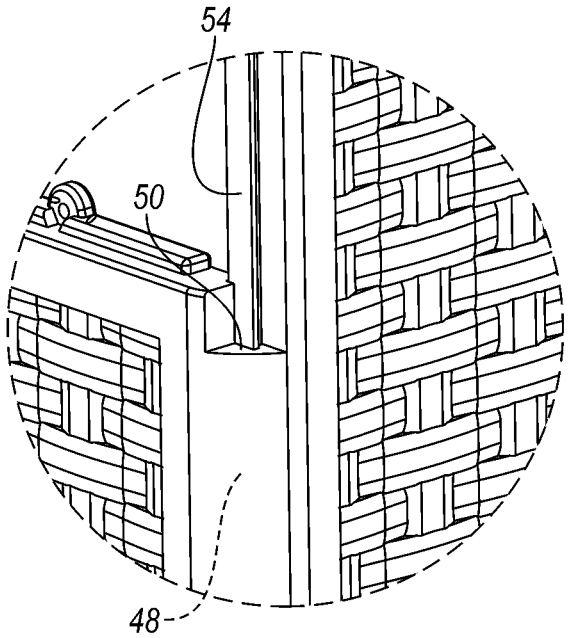
FIG. 4B is an enlarged view of a region of one of the side panels and the front panel of FIG. 4A, labeled in FIG. 4A as region 4B, illustrating the engagement between the guide of the side panel and the rail of the front panel.

With the side panels 16, 18 assembled to the bottom panel 20, the front panel 12 and the back panel 14 can be assembled, as shown in FIGS. 4A-4B. Assembly of the front and back panels 12, 14 to the side panels 16, 18 can be performed via a sliding engagement similar to the assembly of the side panels 16, 18 to the bottom panel 20. In one embodiment, each side panel 16, 18 includes opposing side edge regions 46, 47, each side edge region having a respective guide 48, 49. Each guide 48, 49 is open at a surface 50 facing the top of the side panel, and extends partially or completely to the bottom surface 52. The front panel 12 is provided with a pair of opposing rails 54 at opposing side edge regions. The rails 54 extend longitudinally and vertically (when in the orientation of FIG. 4A). Each rail 54 is sized and configured to fit within one of the guides 48, 49 of both side panels 16, 18. During assembly, the rails 54 can slide through a guide of both side panels 16, 18 simultaneously as the front panel 12 is forced downward toward the bottom panel 20. Like the front panel 12, the back panel 14 is also provided with a pair of opposing rails 56 at opposing side edge regions. The rails 56 also extend longitudinally and vertically (when in the orientation of FIG. 4A). Each rail 56 is sized and configured to fit within one of the guides 48, 49 of both side panels 16, 18 to provide a sliding engagement with the side panels 16, 18 similar to that of the front panel 12.

Similar to the guides 28 described above, the guides 48, 49 can each end to define a stop for engaging with the leading edge of one of the rails of the front and back panels 12, 14.

In one embodiment, the bottom panel 20 is provided with one or more recesses 60 that partially extend into the bottom panel 20 and are concave, facing upward. The front and back panels 12, 14 can each include one or more protrusions or tabs 62 that extend downward and are received by the recess 60. Each recess 60 can be the same or slightly smaller in dimension than the corresponding tabs 62 of the front and back panels 12, 14. This provides additional engagement between bottom panel 20 with the front and back panels 12, 14 after the front and back panels 12, 14 have slid into engagement. This allows a portion of the front and back panels 12, 14 to be fitted within a portion of the bottom panel 20.

Figure 5A:
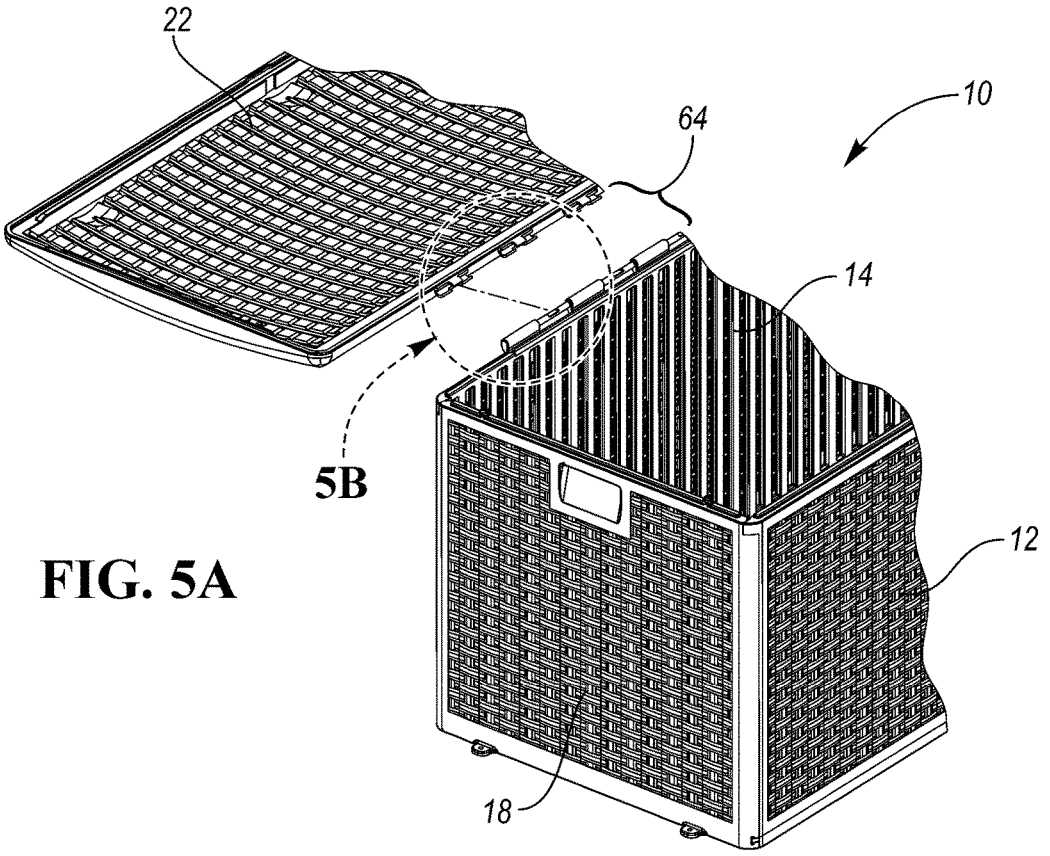
FIG. 5A is a perspective view of a lid with integrally-molded hinge members for engaging with integrally-molded hinge members on the back panel, according to one embodiment.
Figure 5B:
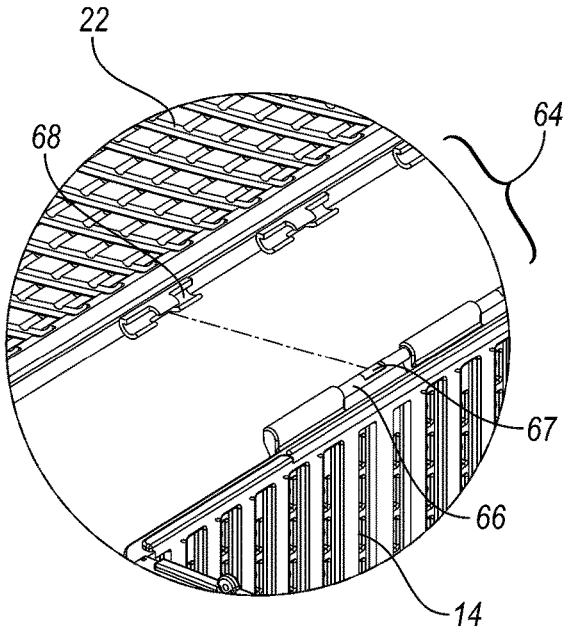
FIG. 5B is an enlarged view of the lid and the back panel of FIG. 5A prior to assembly.
Figure 5C:
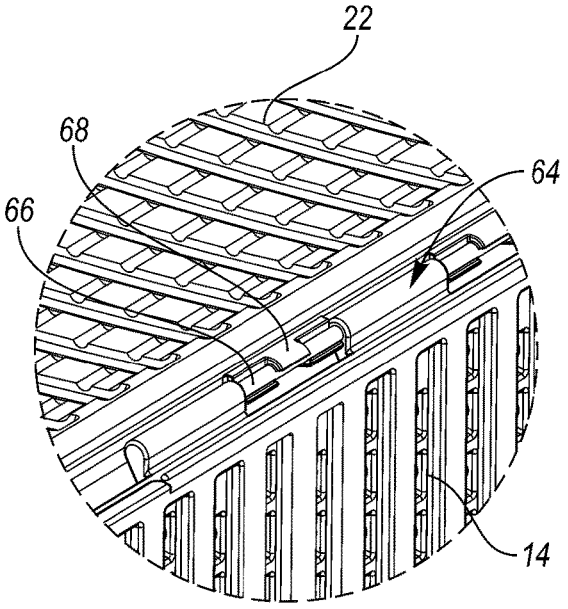
FIG. 5C is an enlarged view of the lid and the back panel of FIG. 5A with the hinge members assembled.

With the side panels 16, 18, the front panel 12 and the back panel 14 assembled, the lid 22 can then be assembled to the back panel 14 to complete assembly, as shown in FIGS. 5A-5C. (It should be noted that the lid 22 can be assembled to the back panel 14 prior to the back panel 14 being assembled to the side panels 16, 18.)

The lid 22 is assembled to the back panel 14 via a hinge 64 that is integrally molded with the deck box 10. Each of the back panel 14 and the lid 22 can have hinge members that are integrally molded therewith. For example, the back panel 14 can include a first hinge member 66 that is integrally molded therewith, and the lid 22 can include a second hinge member 68 that is integrally molded therewith. The first hinge member 66 can be a male hinge member such as a pin, rod, cylinder, or the like; the second hinge member 68 can be a female hinge member that includes a receptacle, pocket, or groove integrally formed therewith for receiving the first hinge member 66.

The flexibility and relative sizing of the hinge members 66, 68 can enable the lid 22 to snap to the back panel 14 at the hinge 64. In one embodiment, the first hinge member 66 can be formed with an outer diameter that exceeds the unbiased inner diameter of the second hinge member 68. Pressing the first hinge member 66 into engagement with the second hinge member can cause protrusions or arms of the second hinge member 68 to flex and open, increasing in inner diameter to receive the first hinge member 66 in a snapping engagement. In another embodiment, the first hinge member 66 can be formed with flattened regions (described below) that allow the first hinge member to be pressed into the second hinge member 68 without causing flexing of the second hinge member 68.

A hinge 64 is formed when the first and second hinge members 66, 68 are connected together. This hingedly connects the lid 22 to the back panel 14, allowing the lid 22 to pivot with respect to the back panel 14 and open and close the deck box 10. The hinge 64 can include a plurality of spaced apart first hinge members 66 and a corresponding plurality of spaced apart second hinge members 68.

The first hinge members 66 can each be formed to include one or more flat regions 67 thereon. In one embodiment, the first hinge members 66 are generally cylindrical except having a recessed or indented flat region 67 at a central region of the first hinge member 66. Another flat region can be provided on either side of the flat region 67 and on the underside of the first hinge member 66. This provides the first hinge member 66 with a reduced diameter or cross-sectional area at the location of the flat regions 67. The flat regions 67 can facilitate the securement of the lid 22 once assembled. For example, the flat region 67 can facilitate the fit of a central tab of the second hinge member 68 about the first hinge member 66 when the lid 22 is in the orientation shown in FIG. 5A. Two other flat regions can be provided on either side of the flat region 67 and on the underside of the pin to align with the other (outer) tabs of the second hinge member 68. The first hinge member 66 can be pressed into the second hinge member 68, with the reduced size at the flat regions 67 causing little or no flex of the second hinge member 68 during connection. Once the second hinge member 68 is snap-fitted about the first hinge member 66, the lid 22 can be rotated to close the deck box 10. Removal of the lid 22 is then more difficult when the lid 22 is rotated because the reduced diameter at the location of the flat region 67 is not engaged with the central tab of the second hinge member 68. Therefore, the second hinge member 68 would have to flex further to allow the entire diameter of the first hinge member 66 (not including the flat region 67) to exit the second hinge member 68 than when the lid is in the open orientation shown in FIG. 5A. The lid 22 can be more easily removed once the lid 22 is rotated back to the orientation shown in FIG. 5A such that the flat regions 67 align with the central tab, requiring little to no flex of the second hinge member 68 when the first hinge member 66 is removed therefrom.

It should be understood that the hinge 64 described above is but one embodiment and the first hinge member 66 and the second hinge member 68 can be swapped in relative location. For example, in another embodiment, the first hinge member 66 is integrally formed with the lid 22 rather than with the back panel 14, and the second hinge member 68 is integrally formed with the back panel 14 rather than with the lid 22.

Each of the panels 12-20 and the lid 22 can be provided with stiffening ribs formed therewith. For example, stiffening ribs 70 are shown in the bottom panel 20 in FIGS. 3A and 3B. The stiffening ribs increase the structural rigidity of the deck box, especially if the deck box is blow-molded to have a hollow interior.

A plurality of anchoring sections may also be provided to facilitate the anchoring of the deck box 10 to an underlying surface, such as a wooden deck or patio. For example, the side panels 16, 18 may be provided with a plurality of feet 72 that extend outward therefrom. The feet 72 can have a lower surface that is coplanar with or slightly elevated from the lower surface of the deck box to be adjacent to the underlying surface. Each of the feet 72 can be provided with an aperture 73 defined therein for a screw, bolt, nail, or other fastener to mount the deck box to the underlying surface.

It should be understood that in the embodiments described above, the "guides" and "rails" of the various panels can be interchanged. For example, while the side panels 16, 18 are illustrated to have a guide 28 extending therethrough to receive a rail of the bottom panel 20, the rails can be located on the side panels 16, 18 and the guide can be located in the bottom panel 20. This understanding applies to all embodiments that have a sliding engagement between panels.

It should also be understood that the front and rear panels can be assembled to the bottom panel first, and then each of the side panels can be slid into engagement between the front and back panels. For example, in one embodiment, the bottom panel is provided with a guide or rail, each extending along the length of the bottom panel at the front edge and rear edge. The front and rear panels also each include a guide or rail for sliding into engagement with the bottom panel. The front and rear panels, or the bottom panel, may be provided with stops to limit the sliding movement of the front and rear panels with respect to the bottom panel, similar to the embodiments described above. With the front and rear panels assembled, the side panels can then be assembled to the front and rear panels, which are each provided with guides or rails that extend along their edges in a direction toward the bottom panel. The side panels each include guides or rails for providing a sliding engagement between the side panels and the front and back panels. Each side panel slides into engagement with the edges of the front and back panels, sliding downward toward the bottom panel until contacting the bottom panel. Like the other embodiments described above, the side panels or front and rear panels may be provided with stops to limit the sliding movement of the side panels toward the bottom panel, causing the side panels to cease sliding when they reach the bottom panel.

The embodiments described above allow the panels to be shipped and sold in a stacked, disassembled configuration with the panels stacked on top of one another, for example. This reduces the required packaging space. A purchaser of the deck box would be able to assemble the panels given the teachings above in a relatively short amount of time and with little difficulty, and without the need for external hardware such as screws, bolts, brackets, etc.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A deck box comprising:

a bottom panel having first and second rails, wherein the first and second rails are protrusions a first side panel slidably connectable to the bottom panel, the first side panel including a first guide being a first pocket configured to receive the first protrusion, wherein the first guide is open at one edge of the first side panel and does not extend an entire length of the first side panel such that a limited engagement path is defined for limiting sliding engagement of the first side panel with the first rail of the bottom panel;

a second side panel slidably connectable to the bottom panel, the second side panel including a second guide being a second pocket configured to receive the second protrusion, wherein the second guide is open at one edge of the second side panel and does not extend an entire length of the second side panel such that a limited engagement path is defined for limiting sliding engagement of the second side panel with the second rail of the bottom panel;

a front panel that slidably connects to the side panels;

a back panel that slidably connects to the side panels, the back panel having a plurality of first hinge members integrally formed with the back panel; and a lid having a plurality of second hinge members integrally formed with the lid that engage with the first hinge members to define a hinged connection between the lid and the back panel.

2. The deck box of claim 1, wherein the first and second guides are T-shaped, and the first and second rails on the bottom panel are T-shaped.

3. The deck box of claim 1, wherein the first and second side panels include rails configured to slidingly engage corresponding guides of the back panel.

4. The deck box of claim 1, wherein the first and second side panels include rails configured to slidingly engage corresponding guides of the front panel.

5. The deck box of claim 1, wherein the first and second guides each define a stop that limits sliding engagement between the side panel and the bottom panel.

6. The deck box of claim 5, wherein the side panels are identical to one another such that sliding engagement of one of the side panels is facilitated in a first direction, and sliding engagement of the other of the side panels is facilitated in a second direction opposite to the first direction.

7. The deck box of claim 1, wherein the first hinge members are rods and the second hinge members are receptacles configured to receive the rods.

8. The deck box of claim 7, wherein the rods include a flat region providing a region of reduced diameter.

9. The deck box of claim 1, wherein the second hinge members are rods and the first hinge members are receptacles configured to receive the rods.

10. The deck box of claim 9, wherein the rods include a flat region providing a region of reduced diameter.

11. The deck box of claim 1, wherein the first side panel includes only a single guide.

* * * * *